US009777978B2

(12) United States Patent
Locher et al.

(10) Patent No.: US 9,777,978 B2
(45) **Date of Patent: *Oct. 3, 2017**

(54) ROTATIONAL SAFETY DEVICE FOR FIREARM

(71) Applicant: S2 LLC, Las Vegas, NV (US)

(72) Inventors: Andrew Locher, Las Vegas, NV (US); Jason Jennings, Las Vegas, NV (US)

(73) Assignee: S2 LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/194,507

(22) Filed: Jun. 27, 2016

(65) Prior Publication Data

US 2017/0097203 A1 Apr. 6, 2017

Related U.S. Application Data

(63) Continuation of application No. 14/153,072, filed on Jan. 12, 2014, now Pat. No. 9,377,260.

(51) Int. Cl.
*F41A 17/00* (2006.01)
*F41A 17/46* (2006.01)

(52) U.S. Cl.
CPC ..... *F41A 17/46* (2013.01)

(58) Field of Classification Search
CPC ..... F41A 17/46
See application file for complete search history.

(56) References Cited

U.S. PATENT DOCUMENTS 1,437,889 A * 12/1922 Eickhoff ..... F41A 19/33 89/138
2,379,461 A 7/1945 Simpson
2,387,669 A 10/1945 Loomis
2,453,683 A * 11/1948 Caldow ..... F41A 17/46 42/70.04
2,512,638 A * 6/1950 Gaidos ..... F41A 19/46 42/69.01
2,533,283 A * 12/1950 Pierce ..... F41A 19/33 42/69.01
4,002,101 A 1/1977 Tellie
4,300,301 A * 11/1981 Morrison ..... F41A 17/46 42/70.06
4,391,058 A * 7/1983 Casull ..... F41A 19/30 42/69.02
5,025,582 A 6/1991 Mote, Sr.
(Continued)

*Primary Examiner* — Gabriel Klein
(74) *Attorney, Agent, or Firm* — Lewis Roca Rothgerber Christie LLP

(57) ABSTRACT

A rotational safety device for a firearm is provided that replaces a traditional cross bar safety device. The safety device is easier to operate and easier for a firearm user to assess whether the firearm can be fired than previous safety systems. The safety device of the present technology involves setting a safety to "fire" or to a no fire or "safety on" position by causing a safety member installed within a trigger mechanism to rotate about an axis. The safety device may include a recessed portion that may be rotationally positioned to face a trigger to allow the trigger to be completely depressed. The safety device may also include one or more locking positions in a range of rotation, physical limits on the range of rotation such as pins that engage surfaces of a firearm, and may be used with a variety devices to provide rotation.

19 Claims, 6 Drawing Sheets

(56) References Cited

U.S. PATENT DOCUMENTS

| | | | | |
|---|---|---|---|---|
| 5,465,517 | A | 11/1995 | Garofalo | |
| 6,173,518 | B1 | 1/2001 | Oberst | |
| 6,256,917 | B1 * | 7/2001 | Findlay | F41A 17/02 42/70.06 |
| 8,276,502 | B1 * | 10/2012 | Wright | F41A 17/46 42/70.01 |
| 2007/0180984 | A1 * | 8/2007 | Huther | F41A 17/74 89/148 |
| 2010/0083550 | A1 | 4/2010 | Ogershok | |
| 2012/0192709 | A1 | 8/2012 | Troy et al. | |

* cited by examiner

ROTATIONAL SAFETY DEVICE FOR FIREARM

CROSS-REFERENCE TO RELATED APPLICATIONS

The present application is continuation of and claims priority to U.S. patent application Ser. No. 14/153,072 filed Jan. 12, 2014, which is set to issue on Jun. 28, 2016 as U.S. Pat. No. 9,377,260, the entire contents of which is incorporated herein by reference.

BACKGROUND

Firearms such as rifles, pistols and shotguns have included a safety mechanism to prevent intended firing of the firearm. Typically, a safety is implemented as a crossbar that may be pushed horizontally in one direction to allow the firearm to be fired and in the opposite horizontal direction to prevent the firearm from being fired.

Though crossbar safeties are reasonably effective, they have disadvantages. A crossbar safety can be difficult to engage while aiming a firearm at a target. The crossbar safety is typically engaged with a user's pointer finger in a curled position. Depressing crossbar safeties in one direction or the other typically moves the firearm itself off a target. Additionally, it is difficult to determine the state of a crossbar safety by looking at the firearm when the firearm is pointed at a target, and can be a safety concern due to the position of the pointer finger. A crossbar safety is usually small and not visible when a firearm is being aimed at a target.

What is needed is an improved safety for a firearm.

SUMMARY

The present technology provides a rotational safety device for a firearm that replaces a traditional cross bar safety device. The safety device is easier to operate and easier for a firearm user to assess whether the firearm can be fired than previous safety systems. The safety device of the present technology involves setting a safety to "fire" or to a no fire or "safety on" position by causing a safety member installed within a trigger mechanism to rotate about an axis. In some instances, a lever or other means may be used to rotate a safety member. The safety device may include a recessed portion that may be rotationally positioned to face a trigger to allow the trigger to be completely depressed. The safety device may also include one or more locking positions in a range of rotation, limits on the range of rotation such as pins that engage surfaces of a firearm, and may be used with a variety of levers or other devices to provide rotation.

In some embodiments, a safety member for providing a rotational safety for a firearm may include a cylindrical portion, a recessed portion and a connection portion. The recessed portion may exist within the cylindrical portion. The connection portion may also exist within the cylindrical portion and may be used to couple the cylindrical portion to an external member that provides rotation. The rotational safety device may be installable in a trigger mechanism of a firearm and configured to rotate within the trigger mechanism.

DETAILED DESCRIPTION

The present technology provides a rotational safety device for a firearm that replaces a traditional cross bar safety device. The safety device is easier to operate and assess whether the firearm can be fired than previous safety systems. The safety device of the present technology involves setting a safety to "fire" or to a no fire or "safety on" position by causing a safety member installed within a trigger mechanism to rotate. In some instances, a lever or other means may be used to rotate a safety member.

The safety device may include a recessed portion that may be rotationally positioned to face a trigger to allow the trigger to be completely depressed. The safety device may also include one or more locking positions in a range of rotation, limits on the range of rotation such as pins that engage surfaces of a firearm, and may be used with a variety of levers or other devices to provide rotation.

When a lever is used, the lever may extend from the trigger frame up along a side of the firearm and may be engaged by a thumb or finger of the firearm user. The lever may be moved in such a manner as to rotate a trigger member that provides the safety setting. Hence, when the lever is moved to a first position, the safety member rotates to a position that sets the safety device in a "safety on" state. When the lever is moved to a second position, the safety member is rotated out of the safety on state and into a "fire" state. The lever may be moved forward or backward to rotate the safety member, which results in toggling between the safety positions, with a thumb or quick swipe of one or more fingers without removing a use's hand from the firearm. Manipulating a lever that extends up a side of the firearm is much easier than pressing a traditional safety button using a single finger in a bent position, which often requires removing the trigger finger from the trigger.

The safety device mechanism may also provide a much easier way to determine whether a firearm safety is turned on or off. For a traditional safety pin, a user of a firearm must look at the pin housed inside a trigger frame to determine if a portion of the pin, usually with red coloring to it, is extending from the trigger frame in a particular direction. Hence, a user must view a small part of the trigger area of previous firearms at a particular angle to look for the pin. The present trigger mechanism includes a lever that can be seen from multiple angles, and even while aiming the firearm at a target. As such, a user of the firearm may quickly determine whether the safety is on without removing the gun from a target, but rather while maintaining the gun aimed at a particular target.

Figure 1:
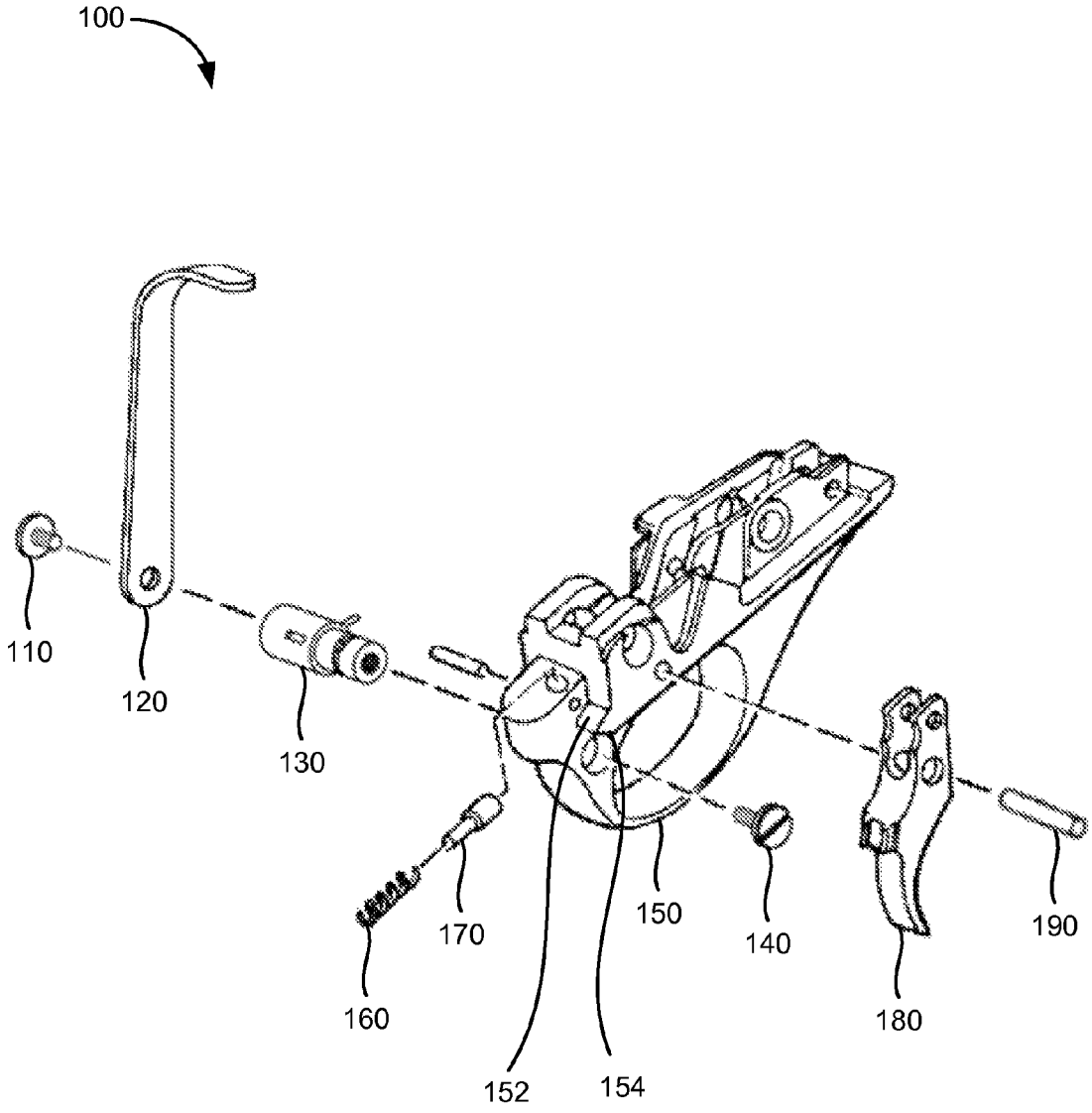
FIG. 1 is an exploded view of a safety system and a trigger mechanism.

FIG. 1 is an exploded view of a safety system and a trigger mechanism. Safety system includes first screw 110, lever 120, safety member 130, and second screw 140. Trigger mechanism includes trigger 180, trigger pin 190, and trigger housing 150. The safety system and a trigger mechanism may be used in a firearm such as a rifle, shotgun, pistol, or other firearm. The details of a particular firearm, such as a barrel, sight, and other parts, are not shown in FIG. 1 for purposes of simplicity.

First screw 110 is used to attach lever 120 to safety member 130. Second screw 140 is used to secure safety member 130 to trigger housing 150. The screws may each attach to a connection portion of the safety member. A connection mechanism may include threads for receiving the screw or other mechanisms configured to attaching the safety member to another part. Though screws are used to assemble the safety system and couple it to the trigger housing, other devices and parts may be used to achieve this purposes.

A guide pin 170 may be installed into trigger housing 150. The guide pin is coupled to a spring 160 which provides a force on guide pin 170 towards the safety member 130. The safety member 130 includes positioning apertures (see FIG. 2-3) to receive the guide pin when the safety member is positioned at a "fire" position and when at a "safety on" position. The guide pin 170 may engage the positioning apertures when the safety member 130 is at the "fire", "safety on" position, or other positions.

Figure 2:
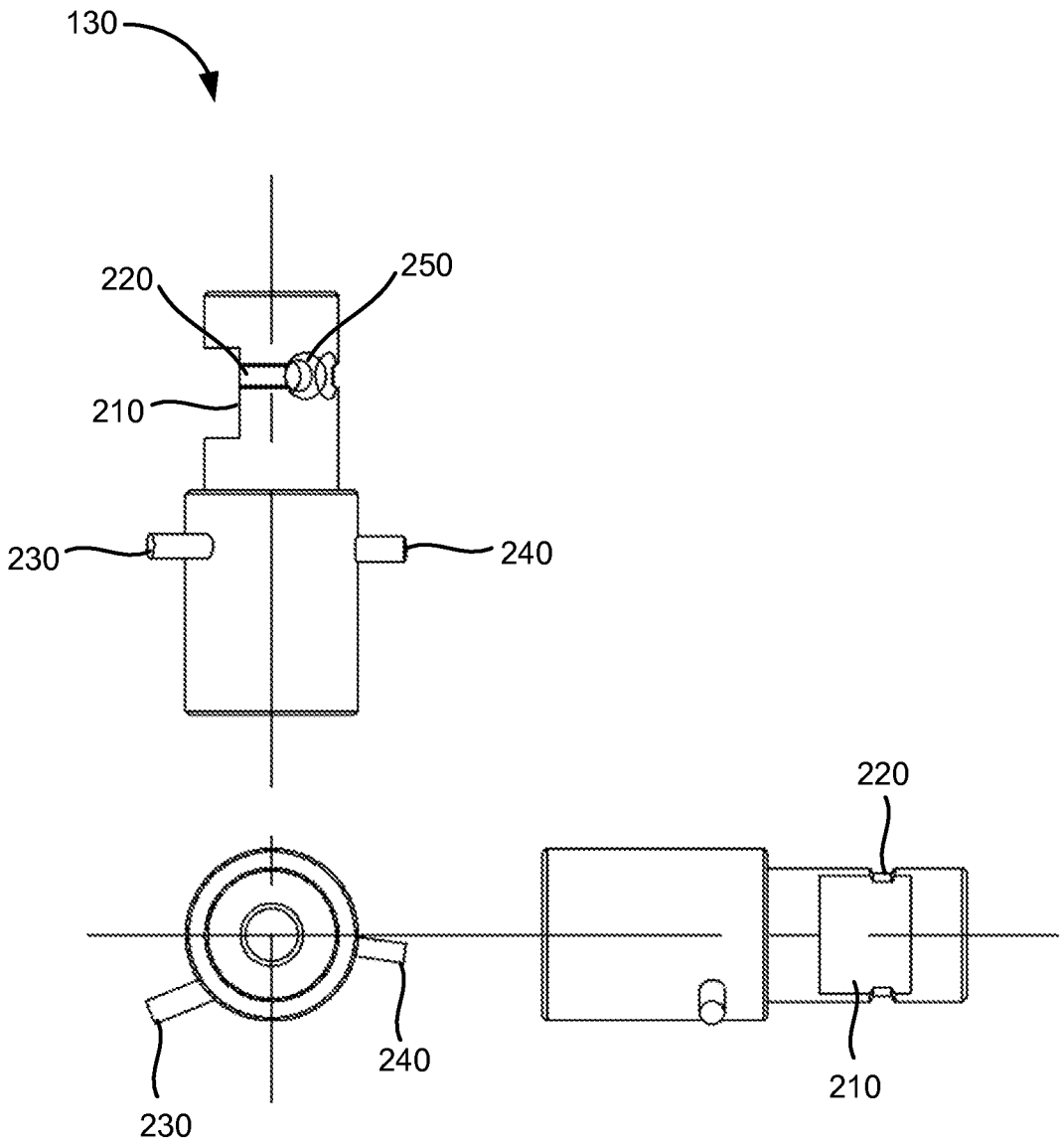
FIG. 2 illustrates an end view (bottom left of FIG. 2), top view (top left of FIG. 2) and side view (bottom right of FIG. 2) of a safety member 130.
Figure 3:
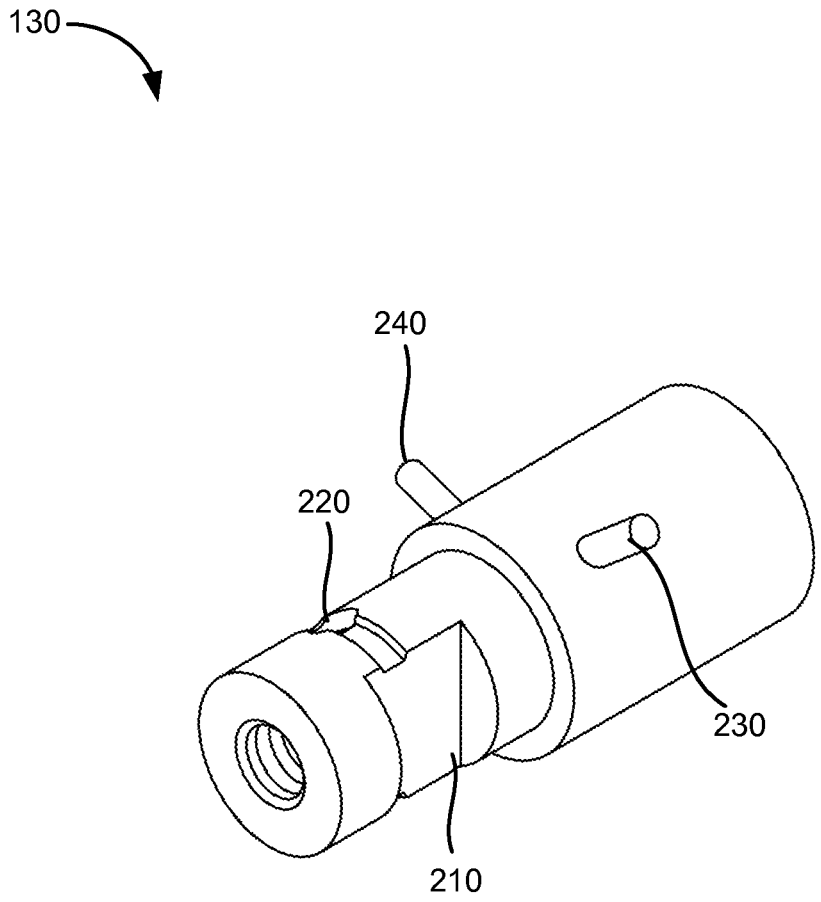
FIG. 3 provides a perspective view of a safety member.

FIG. 2 illustrates an end view (bottom left of FIG. 2), top view (top left of FIG. 2) and side view (bottom right of FIG. 2) of a safety member 130. FIG. 3 provides a perspective view of a safety member. Safety member 130 may include a recessed portion (or notch) 210, a guide 220, positioning apertures 250, and position pins 230 and 240. As shown in the end view, portions of safety member 130 may be cylindrical in shape. Some portions may be cylindrical but have a different radius at other portions. For example, the portion that includes recessed portion 210 may have smaller radius than the portion that includes position pins 230 and 240. Having multiple radius lengths may help maintain the safety member 130 in position when installed within a trigger mechanism.

The recessed portion may enable the trigger to be pulled far enough to fire the firearm. When safety member 130 is rotated into a position associated with the safety being "on", the recessed portion may not be facing the trigger. In this position, the recessed portion 210 may be facing up, down, or otherwise away from the trigger, and a depressed trigger will engage an outer surface of safety member 130 other than recessed portion 210. The outer surface of safety member 130 other than the recessed portion prevents a trigger from being depressed enough to fire the firearm. When safety member 130 is rotated into a position associated with the safety being "off", the recessed portion 210 faces the trigger which allows the trigger to be depressed enough to fire the firearm. In particular, the trigger may be depressed into the recessed portion when the safety member 130 is rotationally positioned such that the recessed portion faces the trigger.

As mentioned with respect to FIG. 1, the positioning apertures 250 may be engaged by guide pin 170. As the safety member 130 is rotated between a safety "on" position and safety "off" position, the guide pin 170 may engage the positioning apertures 250 by extending into an aperture as it aligns with pin 170. A safety member 130 may include one or more positioning apertures 250. Each aperture may include cone or otherwise slanted sidewall.

The cone or slanted side wall may make it easier for the positioning pin to "click" into place inside the aperture but still allow the guide pin 170 to disengage from the aperture when the safety position is changed by a user.

Safety member 130 may include a positioning aperture wherever a lockable position is desired. For example, safety member 130 may include a positioning aperture at a rotational position where the safety is completely on and a rotational position where the safety would be completely off. Guide 220 may guide the guide pin 170 and/or keep the positioning pin in place and aligned with the positioning apertures as the safety member 130 is rotated.

Position pins 230 and 240 may be used to stop rotational movement of the safety member 130 be engaging a surface of a trigger mechanism, firearm surface, or other object. In some embodiments of the present technology, there may be a first position pin to stop rotation of safety member 130 in one direction and a second position pin to stop rotation of safety member 130 in a second direction.

Figure 4:
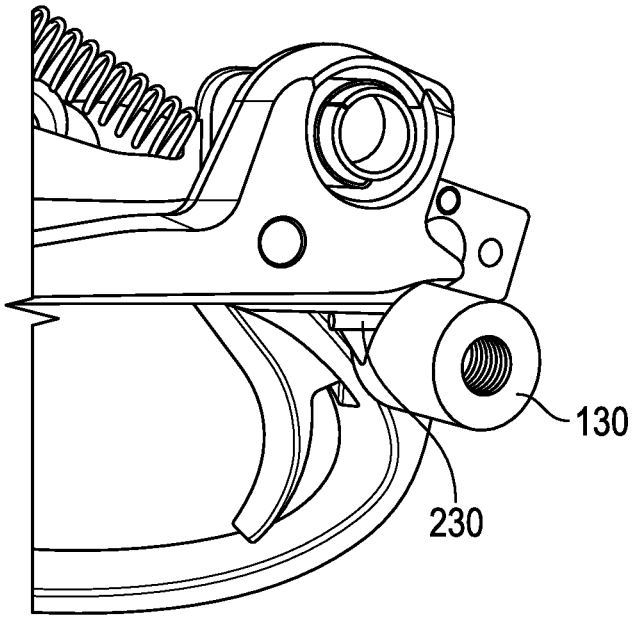
FIG. 4 illustrates a safety member in a first rotational position within a trigger mechanism.

FIG. 4 illustrates a safety member in a first rotational position within a trigger mechanism. In FIG. 4, the safety member 130 is installed into a trigger mechanism and position pin 230 is engaged with a surface of the trigger mechanism. When in this position, the safety member 130 may not be rotated any further in a clockwise position.

Figure 5:
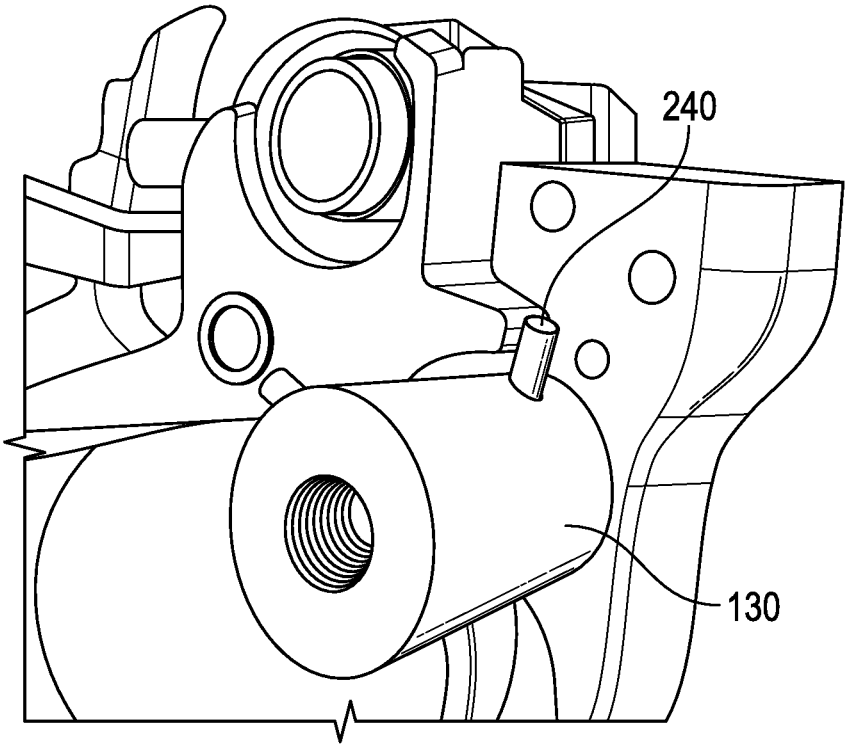
FIG. 5 illustrates a safety member in a second rotational position within a trigger mechanism.

FIG. 5 illustrates a safety member in a second rotational position within a trigger mechanism. The safety member 130 in FIG. 5 is rotationally positioned such that position pin 230 is engaged with a surface of the trigger mechanism. When in this position, the safety member 130 may not be rotated any further in a counter-counter-clockwise position.

Figure 6:
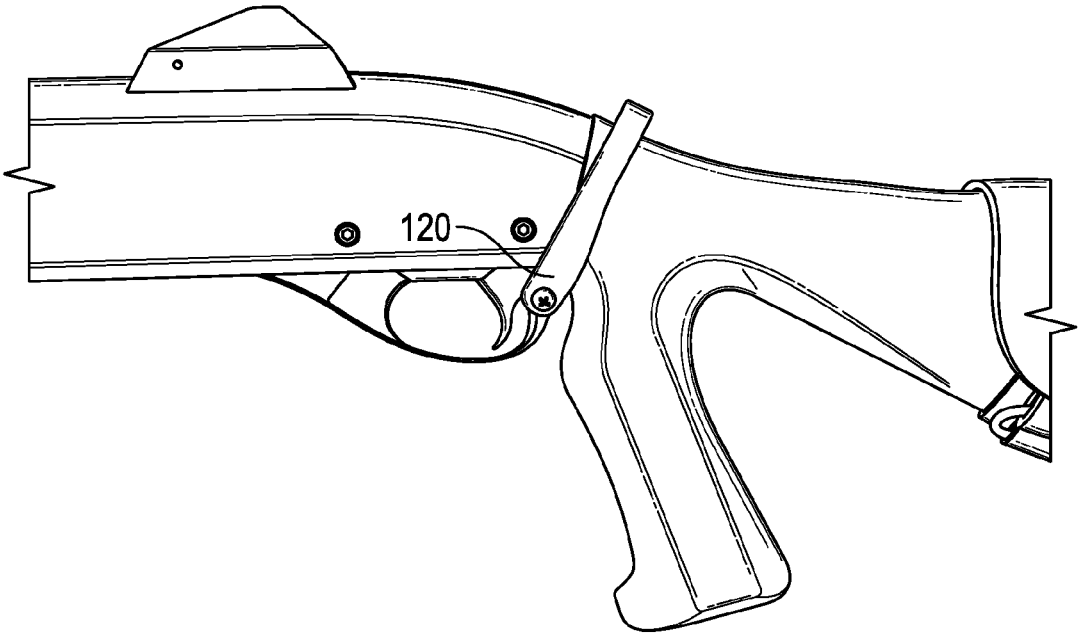
FIG. 6 illustrates a firearm having a rotational safety device with a first lever.
Figure 7:
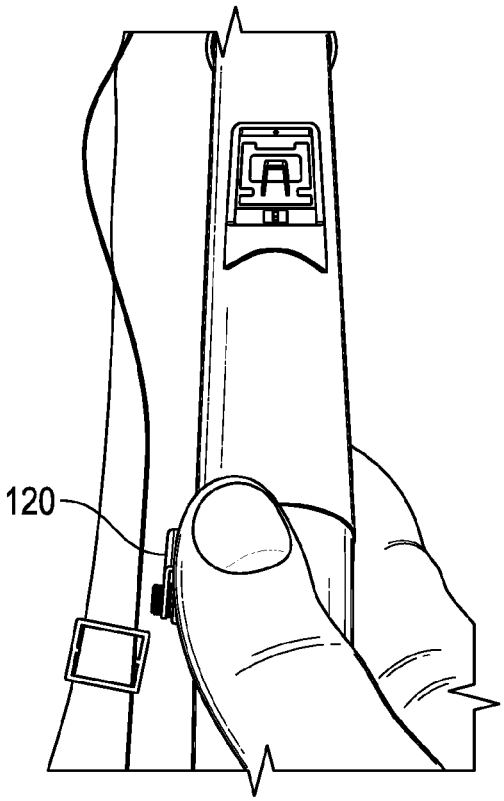
FIG. 7 illustrates a user of a firearm using the rotational safety device of FIG. 6.

In operation, a user of a firearm that includes the safety system and a trigger mechanism would move lever 120 forward or backward along the length of the firearm. FIG. 6 illustrates a firearm having a rotational safety device with a first lever. The lever 120 is attached to an end of the safety member (not shown) and extends towards to the top surface of the firearm. FIG. 7 illustrates a user of a firearm using the rotational safety device of FIG. 6. As shown, the user is handling the firearm with the user's hand over the top of the firearm, and in particular with the user's thumb over the top of the firearm. As such, the lever is accessible to the user's finger for rotationally setting the safety on and off by moving the lever forward or backward.

Figure 8:
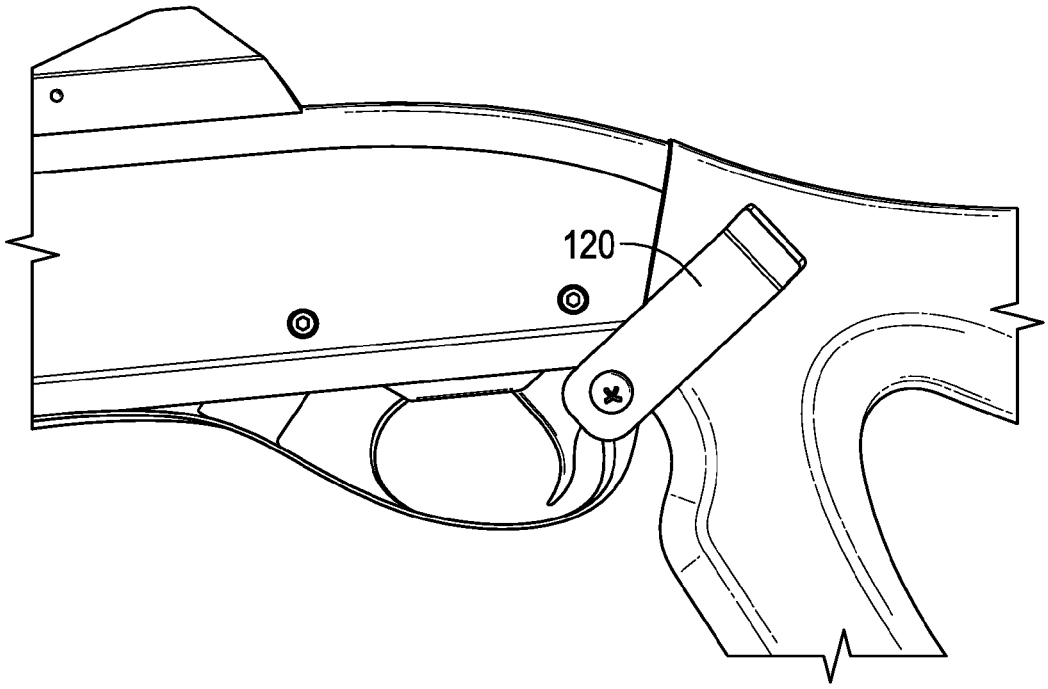
FIG. 8 illustrates a firearm having a rotational safety device with a second lever.
Figure 9:
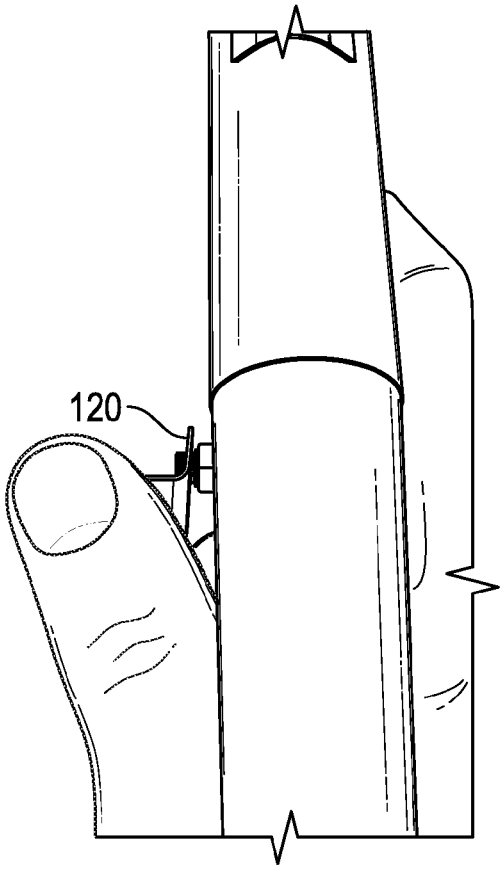
FIG. 9 illustrates a user of a firearm using the rotational safety device of FIG. 8.

FIG. 8 illustrates a firearm having a rotational safety device with a second lever. The lever 120 of FIG. 8 is attached to an end of the safety member (not shown) and extends upwards towards the top surface of the firearm, but does not reach the top of the firearm. FIG. 9 illustrates a user of a firearm using the rotational safety device of FIG. 8. As shown, the user is handling the firearm with the user's hand underneath the firearm. The lever of FIG. 9 is positioned to allow a user's thumb to engage the lever to move it forward or backward, thereby rotating the safety member.

The present technology is described above with reference to exemplary embodiments. It will be apparent to those skilled in the art that various modifications may be made and other embodiments can be used without departing from the broader scope of the present technology. For example, the present technology may be implemented for right handed users and left handed users. Therefore, these and other variations upon the exemplary embodiments are intended to be covered by the present technology.

What is claimed is:

1. A firearm safety apparatus, the safety apparatus comprising:

a rotational replacement trigger safety adapted to replace a safety of a firearm, the rotational replacement trigger safety having a cylindrical member, the cylindrical member having a first cylindrical portion and a second cylindrical portion, the first cylindrical portion having a first diameter, wherein the first cylindrical portion is adapted to rotate between at least a first position and a second position within a hole disposed in a trigger housing of the firearm and includes a notched region, an unnotched region, and a plurality of positioning apertures, wherein the notched region is adapted to receive a rear portion of a trigger of the firearm with respect to a firing direction of the firearm when the first cylindrical portion is in the first position and the notched region is adapted to not receive the rear portion of the trigger when the first cylindrical portion is in the second position, wherein the unnotched region is adapted to face and abuttedly engage the rear portion of the trigger when the first cylindrical portion is in the second position and the unnotched region is adapted to not face the rear portion of the trigger when the first cylindrical portion is in the first position, and wherein the positioning apertures are each adapted to successively engage a guide pin of the trigger housing of the firearm when the first cylindrical portion is rotated within the hole, and the second cylindrical portion has a second diameter greater than the first diameter.

2. The firearm safety apparatus of claim 1, further comprising a lever coupled to the cylindrical member of the rotational replacement trigger safety.

3. The firearm safety apparatus of claim 1, wherein the first cylindrical portion further comprises a guide adapted to maintain the guide pin in alignment with the positioning apertures.

4. The firearm safety apparatus of claim 1, wherein one or more of the positioning apertures has a slanted sidewall.

5. The firearm safety apparatus of claim 1, wherein a first positioning aperture of the one or more of the positioning apertures abuttedly engages the guide pin when the first cylindrical portion is in the first position.

6. The firearm safety apparatus of claim 5, wherein a second positioning aperture of the one or more of the positioning apertures abuttedly engages the guide pin when the first cylindrical portion is in the second position.

7. The firearm safety apparatus of claim 6, wherein a third positioning aperture of the one or more of the positioning apertures abuttedly engages the guide pin when the first cylindrical portion is in a third position between the first position and the second position.

8. The firearm safety apparatus of claim 1, wherein the firearm is a shotgun, rifle, or pistol.

9. A firearm safety apparatus, the safety apparatus comprising:

a rotational replacement trigger safety adapted to replace a safety of a firearm, the rotational replacement trigger safety having a safety member, the safety member comprising a cylindrical member adapted to rotate between at least a first position and a second position within a hole, wherein the cylindrical member further comprises a guide adapted to maintain the guide pin in alignment with the positioning apertures disposed in a trigger housing of the firearm, wherein the cylindrical member includes a notched region, an unnotched region, and a plurality of positioning apertures aligned along a circumferential axis passing through the notched_region of the cylindrical member, wherein the notched region is adapted to receive a rear portion of a trigger of the firearm with respect to a firing direction of the firearm when the cylindrical member is in the first position and the notched region is adapted to not receive the rear portion of the trigger when the cylindrical member is in the second position, wherein the unnotched region is adapted to face and abuttedly engage the rear portion of the trigger when the cylindrical member is in the second position and the unnotched region is adapted to not face the rear portion of the trigger when the cylindrical member is in the first position, and wherein the positioning apertures are adapted to successively engage a guide pin of the trigger housing of the firearm when the cylindrical member is rotated within the hole.

10. The firearm safety apparatus of claim 9, further comprising a lever coupled to the cylindrical member of the rotational replacement trigger safety.

11. The firearm safety apparatus of claim 9, wherein one or more of the positioning apertures has a slanted sidewall.

12. The firearm safety apparatus of claim 9, wherein a first positioning aperture of the one or more of the positioning apertures abuttedly engages the guide pin when the cylindrical member is in the first position.

13. The firearm safety apparatus of claim 12, wherein a second positioning aperture of the one or more of the positioning apertures abuttedly engages the guide pin when the cylindrical member is in the second position.

14. The firearm safety apparatus of claim 13, wherein a third positioning aperture of the one or more of the positioning apertures abuttedly engages the guide pin when the cylindrical member is in a third position between the first position and the second position.

15. The firearm safety apparatus of claim 9, wherein the firearm is a shotgun, rifle, or pistol.

16. A firearm safety apparatus, the safety apparatus comprising:

a rotational replacement trigger safety adapted to replace a crossbar safety of a firearm, the rotational replacement trigger safety having a safety member, the safety member comprising a first cylindrical member and a second cylindrical member, the first cylindrical member having a first diameter, wherein the first cylindrical member is adapted to rotate between at least a first position and a second position within a hole disposed in a trigger housing of the firearm and includes a notched region, an unnotched region, and a plurality of positioning apertures aligned along a circumferential axis passing through the notched region of the first cylindrical member, wherein the notched region is adapted to face a rear portion of a trigger of the firearm with respect to a firing direction of the firearm when the first cylindrical member is in the first position and the notched region is adapted to face away from the rear portion of the trigger when the first cylindrical member is in the second position, wherein the unnotched region is adapted to face and abuttedly engage the rear portion of the trigger when the first cylindrical member is in the second position and the unnotched region is adapted to face away from the rear portion of the trigger when the first cylindrical member is in the first position, and wherein the positioning apertures are adapted to successively engage a guide pin of the trigger housing of the firearm when the first cylindrical member is rotated within the hole, and the second cylindrical member has a second diameter greater than the first diameter.

17. The firearm safety apparatus of claim 16, wherein a first positioning aperture of the one or more of the positioning apertures abuttedly engages the guide pin when the first cylindrical member is in the first position.

18. The firearm safety apparatus of claim 17, wherein a second positioning aperture of the one or more of the positioning apertures abuttedly engages the guide pin when the first cylindrical member is in the second position.

19. The firearm safety apparatus of claim 18, wherein a third positioning aperture of the one or more of the positioning apertures abuttedly engages the guide pin when the first cylindrical member is in a third position between the first position and the second position.

* * * * *